US006263517B1

(12) United States Patent
Brooks

(10) Patent No.: US 6,263,517 B1
(45) Date of Patent: Jul. 24, 2001

(54) TOILET SEAT AND COVER LIFTER

(76) Inventor: Thomas K. Brooks, 3200 Ellis St., Apt. 1, Stevens Point, WI (US) 54481

( * ) Notice: Subject to any disclaimer, the term of this patent is extended or adjusted under 35 U.S.C. 154(b) by 0 days.

(21) Appl. No.: 09/650,997

(22) Filed: Aug. 28, 2000

Related U.S. Application Data

(60) Provisional application No. 60/165,173, filed on Nov. 12, 1999.

(51) Int. Cl.[7] ..... A47K 13/10
(52) U.S. Cl. ..... 4/246.1; 4/246.3
(58) Field of Search ..... 4/246.1, 246.3–246.5, 4/241

(56) References Cited

U.S. PATENT DOCUMENTS

| | | | | |
|---|---|---|---|---|
| 2,251,770 | | 8/1941 | Warner | 4/251 |
| 2,473,082 | | 6/1949 | Warner | 4/251 |
| 5,435,017 | * | 7/1995 | Pan | 4/246.2 |
| 5,806,106 | | 9/1998 | Carter et al. | 4/246.1 |
| 5,829,067 | | 11/1998 | Smith | 4/246.1 |
| 5,940,896 | * | 8/1999 | Berring | 4/241 |

* cited by examiner

*Primary Examiner*—Gregory L. Huson
*Assistant Examiner*—Tuan Nguyen
(74) *Attorney, Agent, or Firm*—Donald J. Ersler

(57) ABSTRACT

A toilet seat and cover lifter includes a seat lifting assembly and a cover lifting assembly. Each lifting assembly includes a lifting plate, a pair of arms, a pair of counterweights, a vertical handle, and a vertical handle retainer. The seat lifting assembly is installed in the following manner. The lifting plate is mounted to a bottom of the toilet seat. Each arm extends from an end of the lifting plate. Each arm has a slot formed in a length thereof. At least one counterweight is slidably attached to each arm. The counterweights are adjusted by sliding thereof in the slot to reduce the amount force required to move the toilet seat to an upright position. The vertical handle is pivotally attached to an end of either arm. The vertical handle is radially retained inside a vertical handle retainer which is mounted to a side of the toilet tank. The cover lifting assembly is installed in a similar manner to the seat lifting assembly. Two foot pedals with cords may be substituted for the seat vertical handle.

17 Claims, 10 Drawing Sheets

TOILET SEAT AND COVER LIFTER

CROSS-REFERENCES TO RELATED APPLICATIONS

This is a utility application taking priority from provisional application, Ser. No. 60/165,173 filed on Nov. 12, 1999.

BACKGROUND OF THE INVENTION

1. Field of the Invention

The present invention relates generally to toilet seats and more specifically to a toilet seat and cover lifter which allows a toilet seat and cover to be lifted without touching thereof.

2. Discussion of the Prior Art

Sometimes it may be unsanitary to lift a toilet seat or toilet cover by hand, especially when a large number people have used the same toilet. It is also painful for someone with a back problem to bend over and lift a toilet seat by hand. There have been several patents directed at remedying these problems with foot pedals, lift handles, and vertical handles. The drawback to the foot pedal type of toilet seat lifter is the lack of simplicity. The drawback to the lift handles is the requirement that someone with a bad back bend over to pull-up the lift handle. Further, the lift handles are usually close to the toilet seat which may make them less sanitary.

Accordingly, there is a clearly felt need in the art for a toilet seat lifter which allows for sanitary handling of toilet seats and/or toilet covers; and the lifting of a toilet seat and/or toilet cover by someone with a bad back with a small amount of effort.

SUMMARY OF THE INVENTION

The primary objective of the present invention is to provide a toilet seat lifter which allows for sanitary handling of toilet seats and/or toilet covers; and the lifting of a toilet seat and/or toilet cover by someone with a bad back with a small amount of effort.

According to the present invention, a toilet seat and cover lifter includes a seat lifting assembly and a cover lifting assembly. Each lifting assembly includes a lifting plate, a pair of arms, a pair of counterweights, a vertical handle, and a vertical handle retainer. The seat lifting assembly is installed in the following manner. The lifting plate is mounted to a bottom of the toilet seat. Each arm extends from an opposite end of the lifting plate. Each arm has a slot formed in a length thereof. At least one counterweight is fastened to each arm through the slot. The counterweights are adjusted by sliding thereof in the slot to reduce the amount force required to move the toilet seat to an upright position. The vertical handle is pivotally attached to an end of either arm. Someone with a bad back does not have to bend over to actuate either vertical handle. Each vertical handle is radially retained inside a vertical handle retainer which is mounted to a side of the toilet tank.

The cover lifting assembly is installed in a similar manner to the seat lifting assembly. The only exception is that the vertical handle for the cover lifting assembly is preferably mounted on the side opposite the vertical handle for the seat lifting assembly.

Two foot pedals may be installed to lift and lower the toilet seat. One end of a lifting cord is attached to an end of a lifting pedal and the other end of the lifting cord is attached to a bottom of the seat vertical handle. One end of a lowering cord is attached to an end of a lowering pedal and the other end of the lowering cord is attached to an end of the seat lifting plate. When the toilet seat is in a horizontal position, the lifting pedal is stepped on to raise the toilet seat. When the toilet seat is in an upright position, the lowering pedal is stepped on to lower the toilet seat. The amount of foot pressure required to lift or lower the toilet seat is very small, because the seat and cover lifting assemblies are counterweighted.

Accordingly, it is an object of the present invention to provide a toilet seat and cover lifter which requires only a small amount force to lift a toilet seat.

It is a further object of the present invention to provide a toilet seat and cover lifter which requires only a small amount force to lift a toilet cover.

It is yet a further object of the present invention to provide a toilet seat and cover lifter which has a vertical handle that is not positioned close to the toilet seat or cover for sanitary purposes.

Finally, it is another object of the present invention to provide a toilet seat and cover lifter which may be used by an individual with a bad back without aggravating their back condition.

These and additional objects, advantages, features and benefits of the present invention will become apparent from the following specification.

DETAILED DESCRIPTION OF THE PREFERRED EMBODIMENTS

Figure 1:
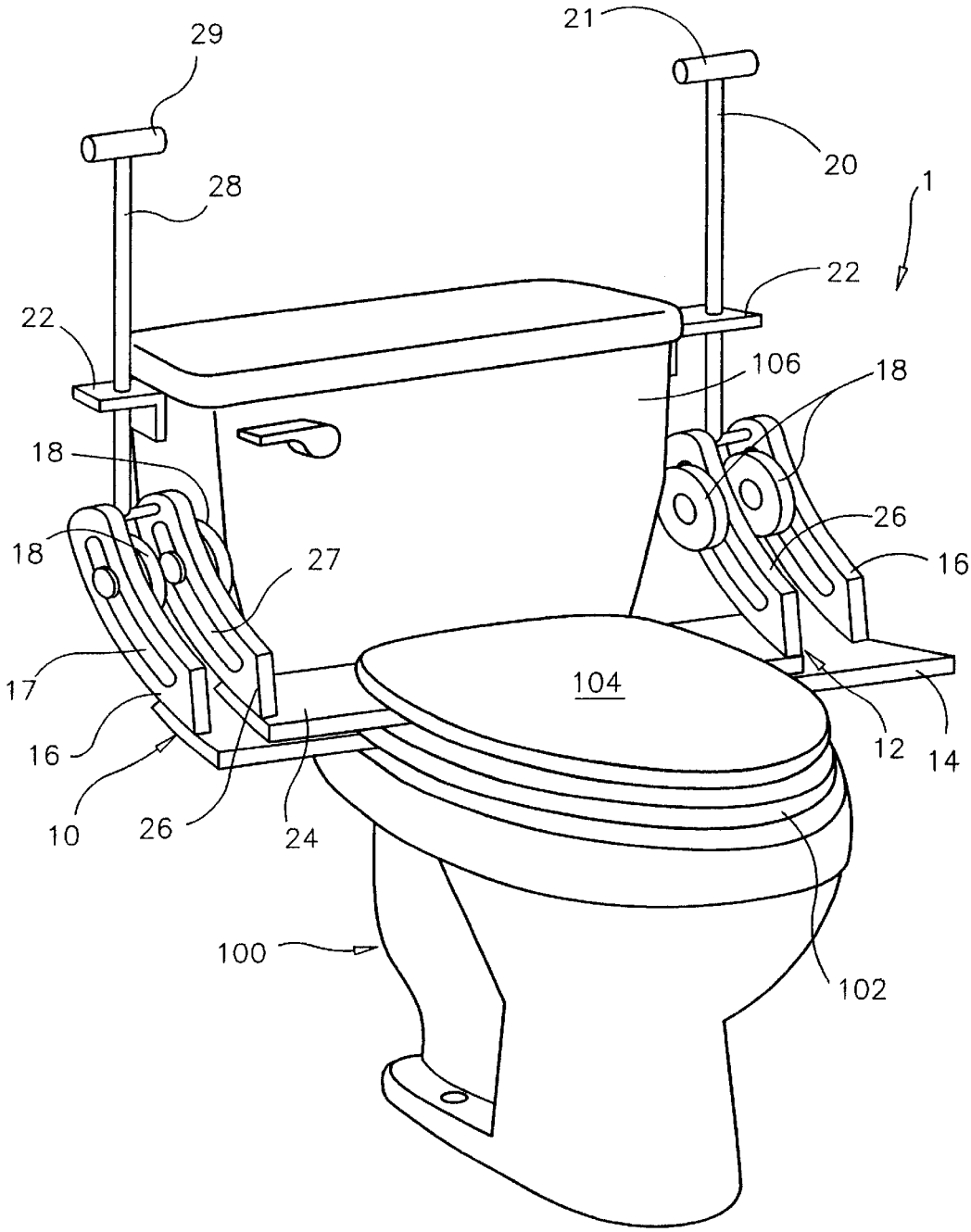
FIG. 1 is a perspective view of a toilet seat and cover lifter which has the toilet cover in a horizontal position in accordance with the present invention.
Figure 2:
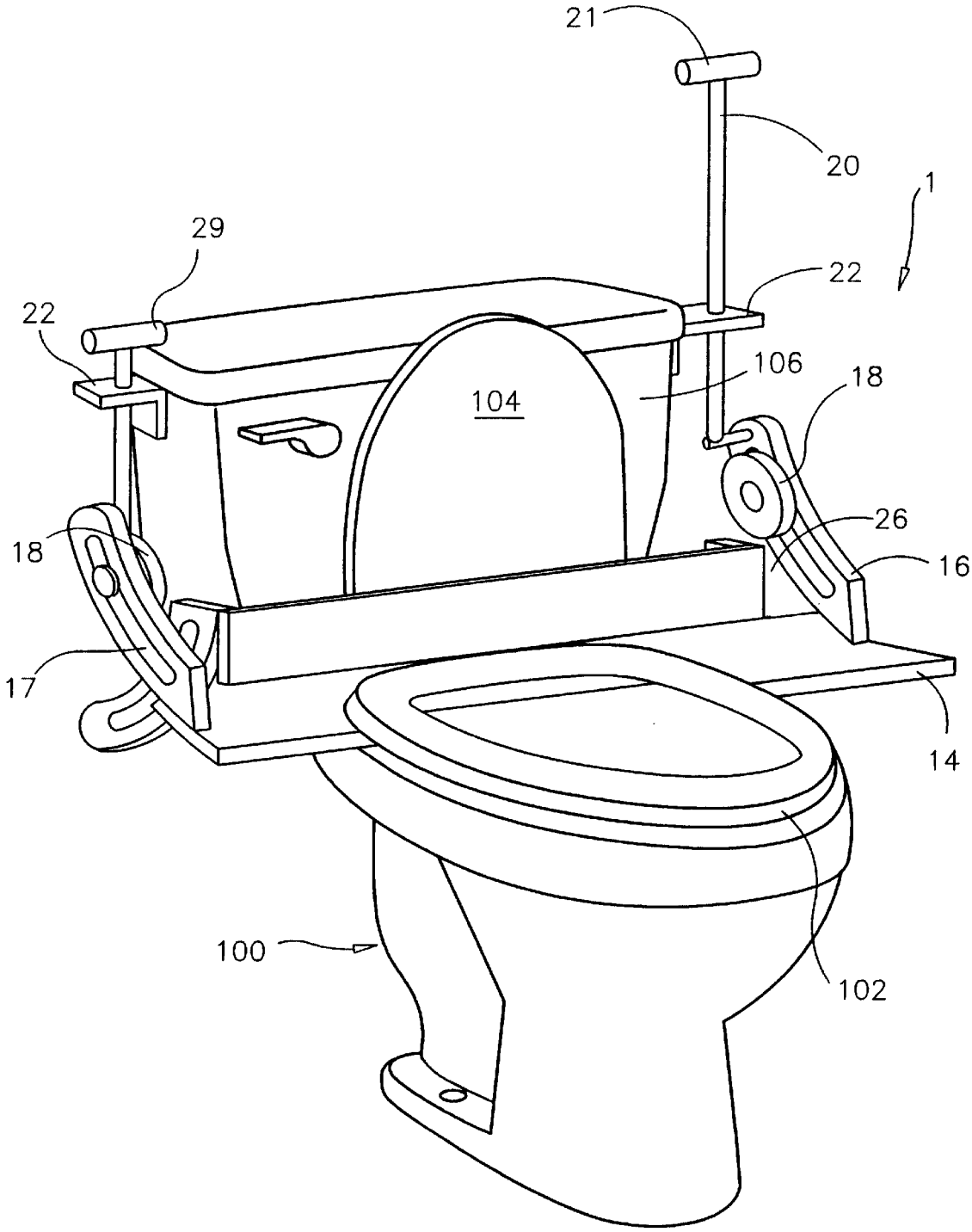
FIG. 2 is a perspective view of a toilet seat and cover lifter which has the toilet cover in an upright position in accordance with the present invention.
Figure 3:
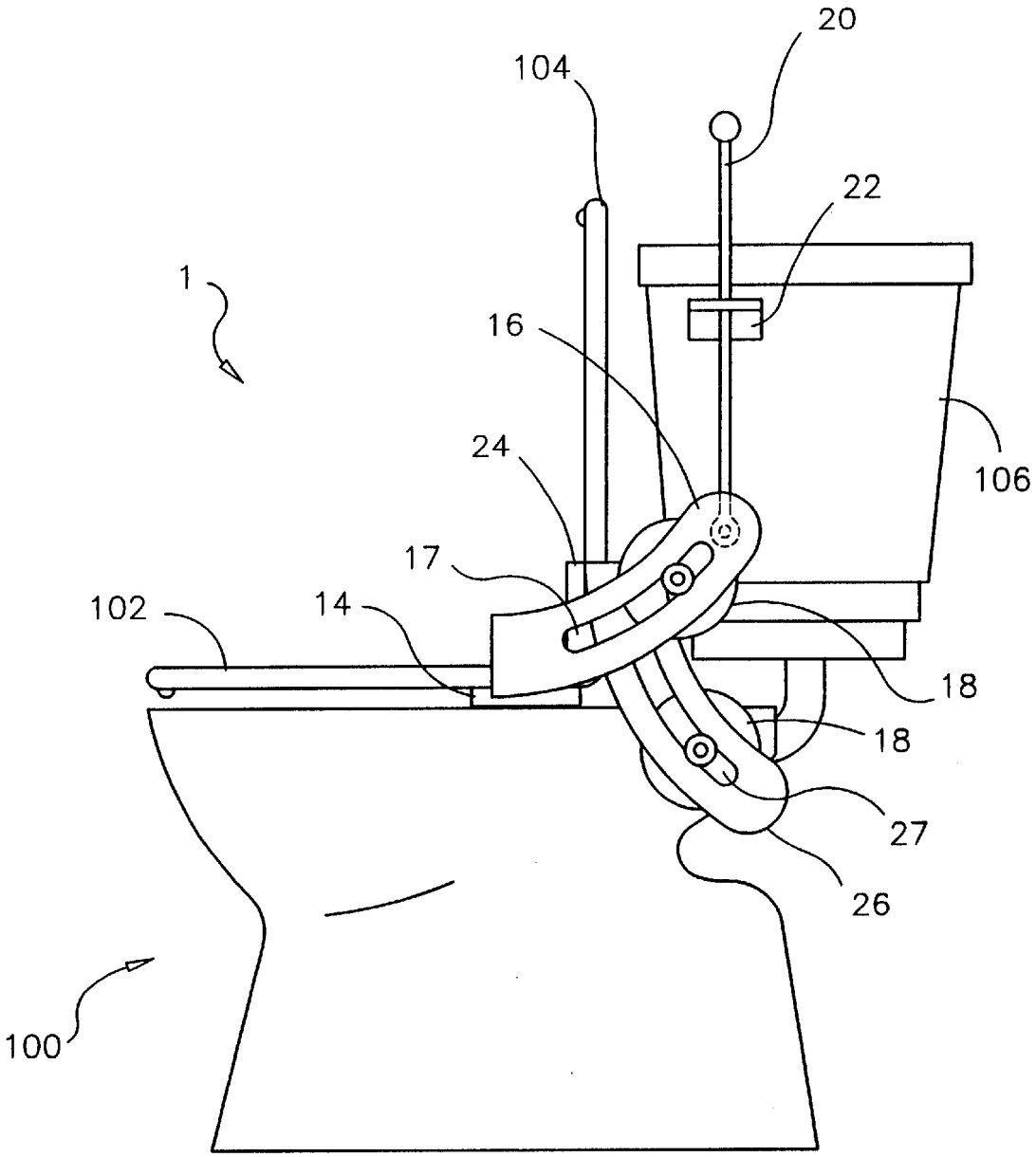
FIG. 3 is a right side view of a toilet seat and cover lifter with the toilet cover in an upright position in accordance with the present invention.
Figure 4:
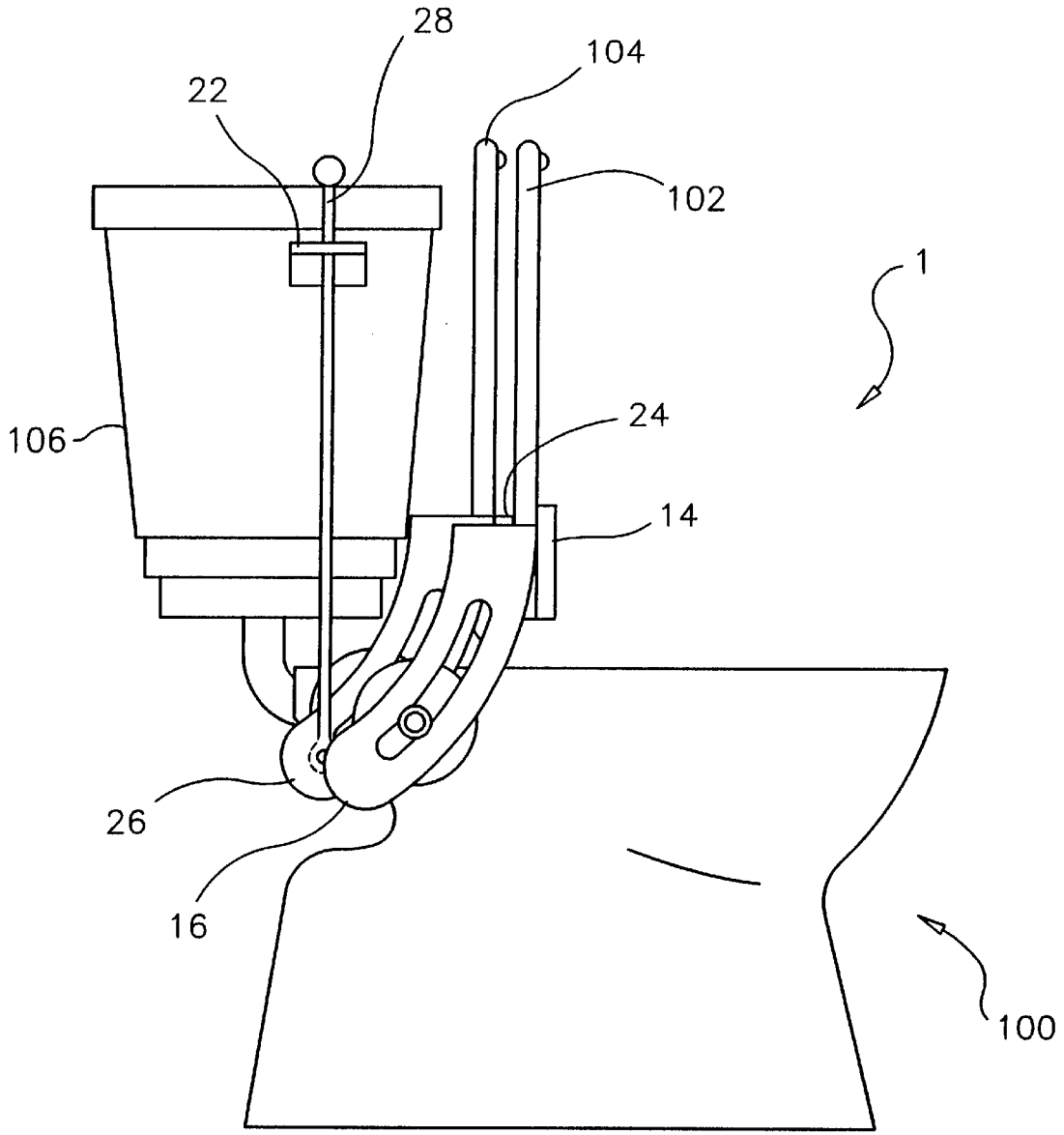
FIG. 4 is a left side view of a toilet seat and cover lifter with the toilet seat and cover in an upright position in accordance with the present invention.
Figure 5:
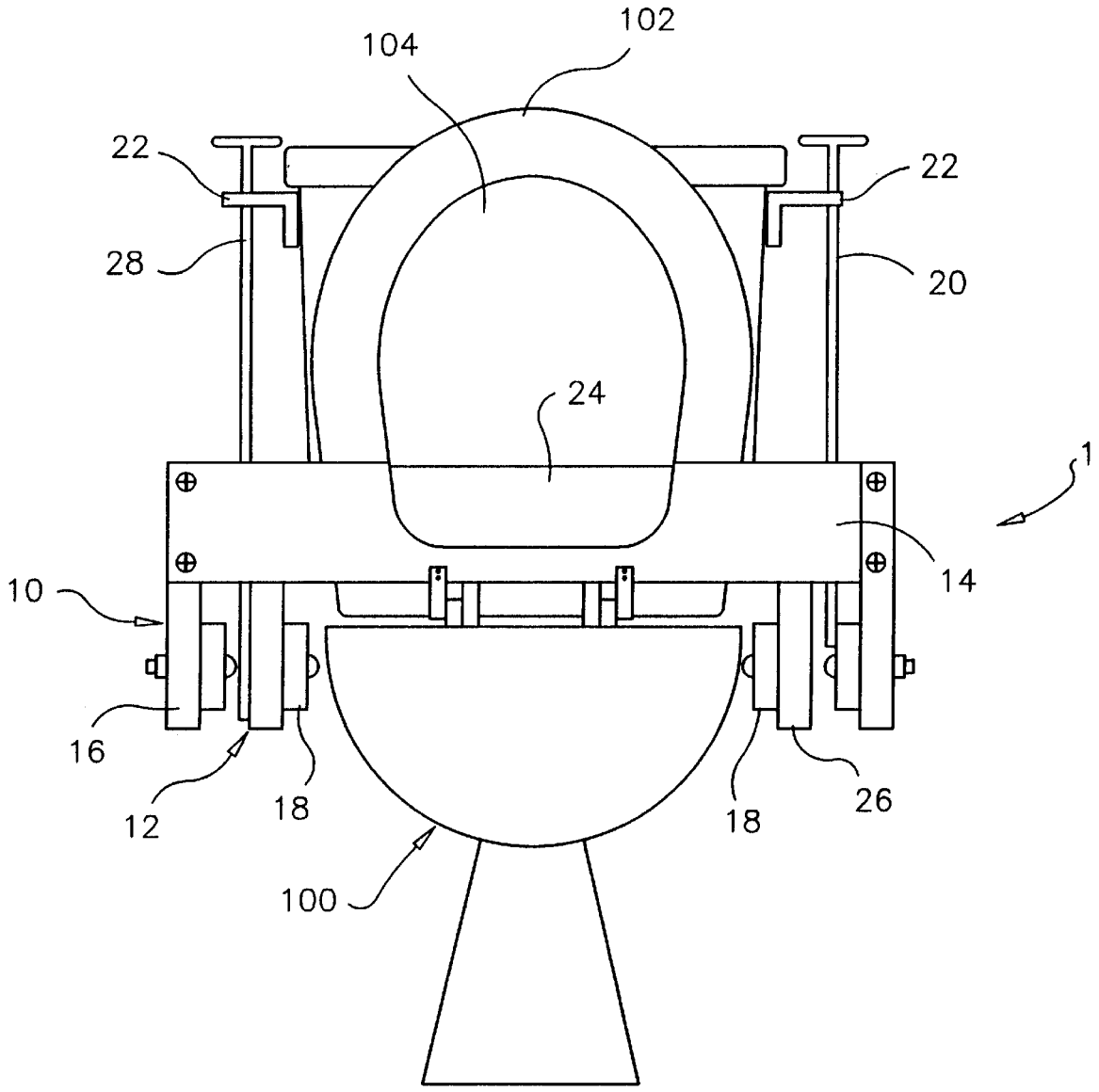
FIG. 5 is a front view of a toilet seat and cover lifter with the toilet seat and cover in an upright position in accordance with the present invention.
Figure 6:
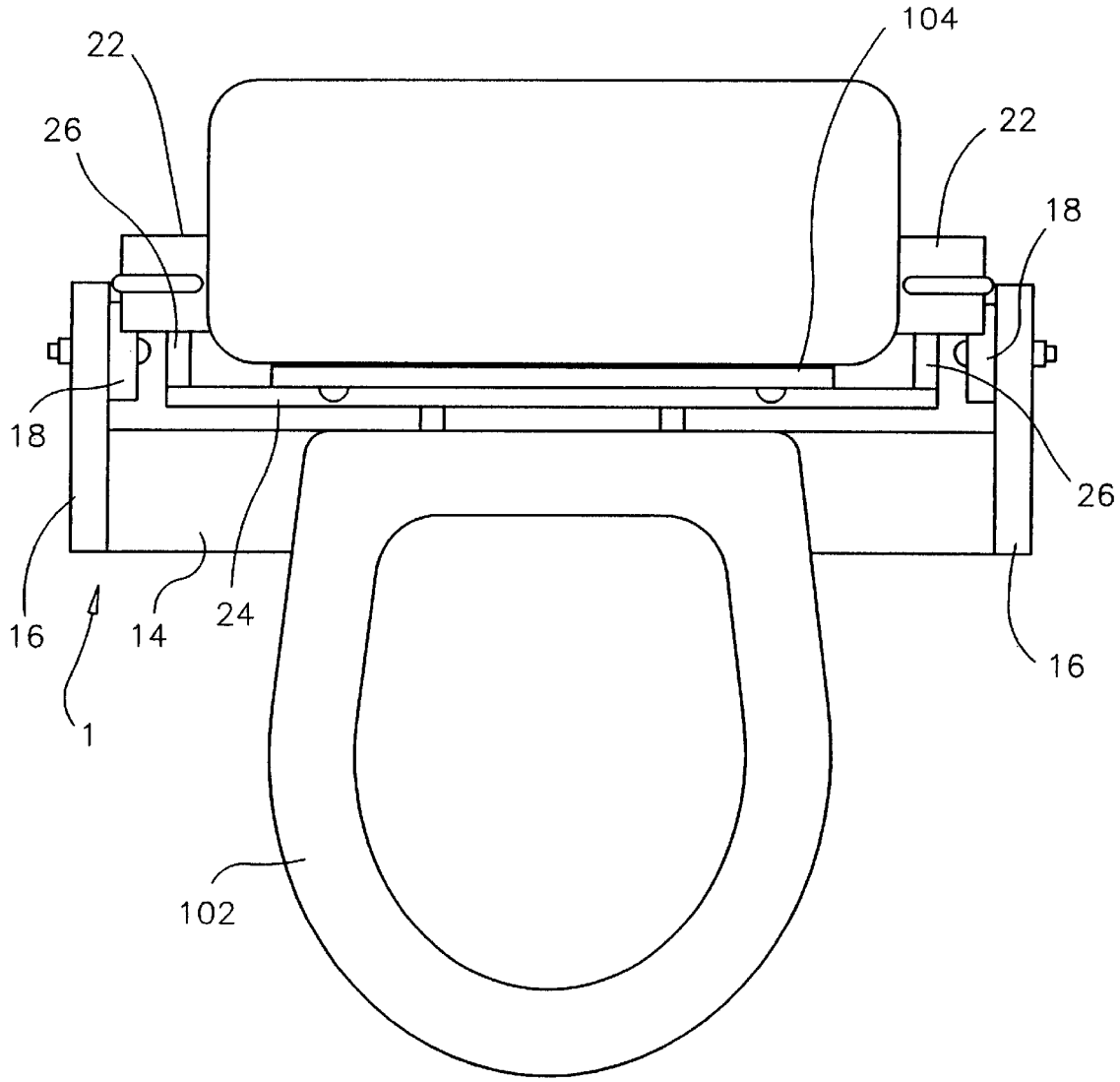
FIG. 6 is a top view of a toilet seat and cover lifter with the toilet cover in a horizontal position in accordance with the present invention.
Figure 7:
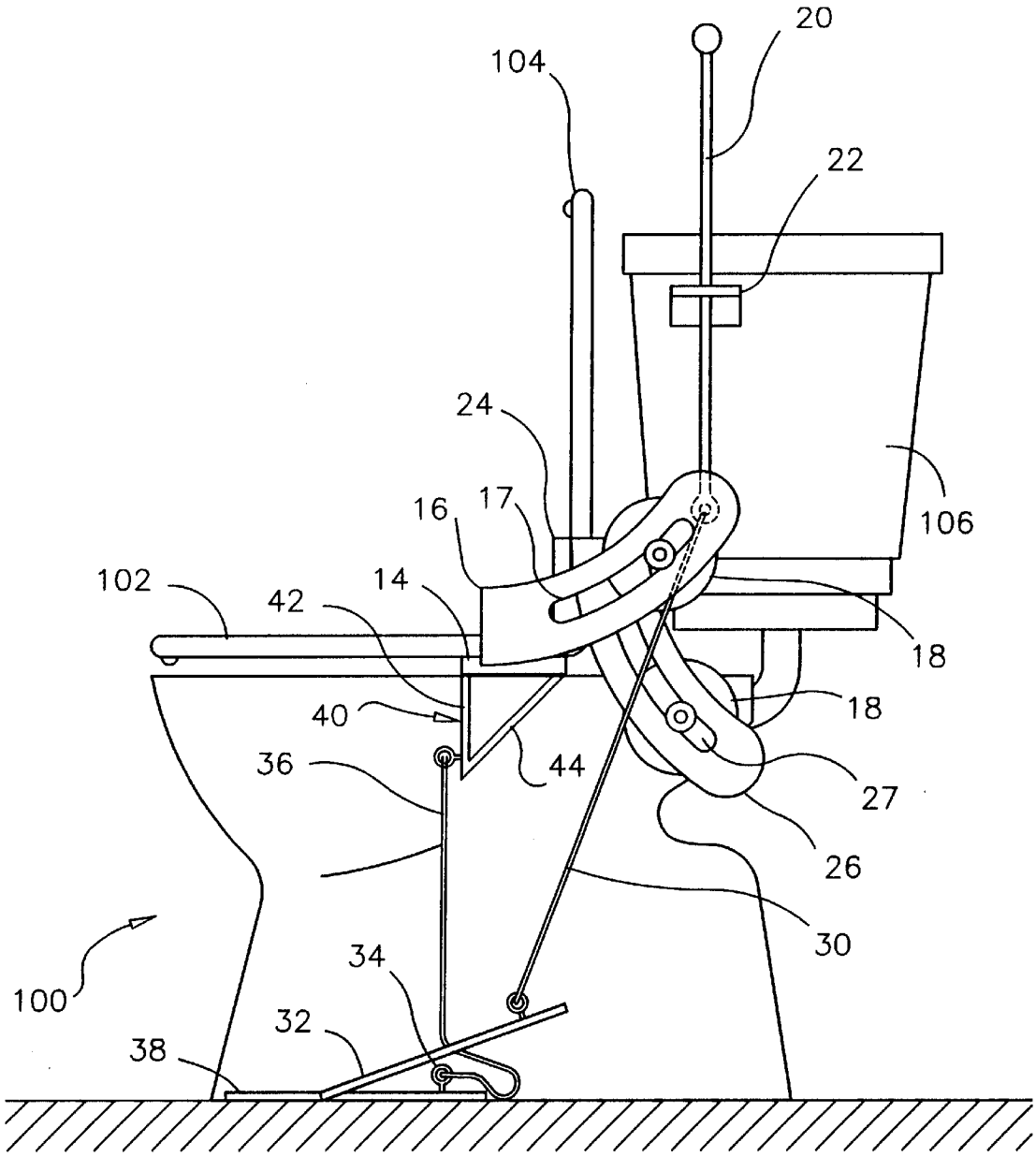
FIG. 7 is a right side view of a toilet seat and cover lifter with the toilet seat in a horizontal position and with two foot pedals installed to lift and lower the toilet seat in accordance with the present invention.
Figure 8:
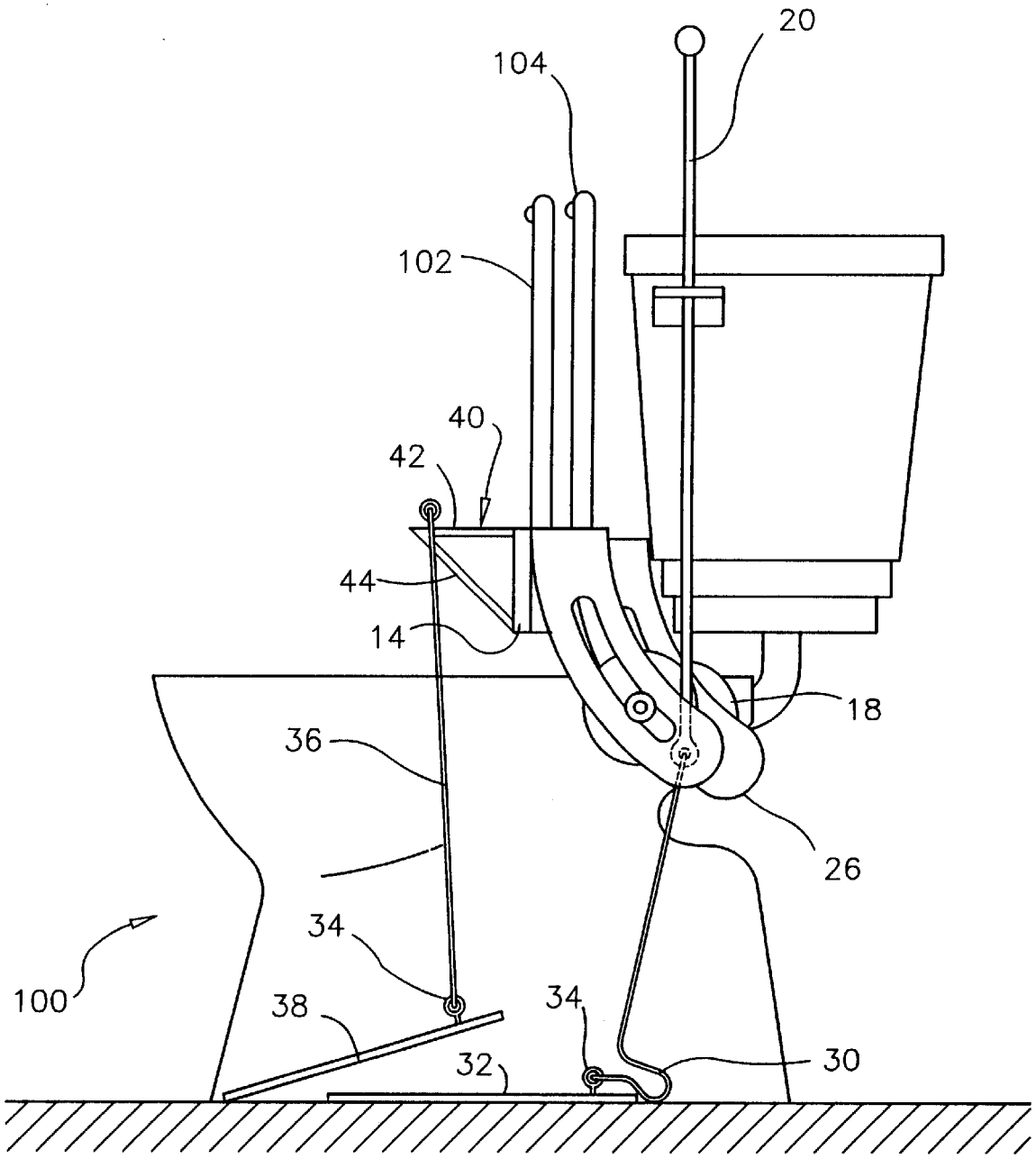
FIG. 8 is a right side view of a toilet seat and cover lifter with the toilet seat in an upright position and with two foot pedals installed to lift and lower the toilet seat in accordance with the present invention.
Figure 9:
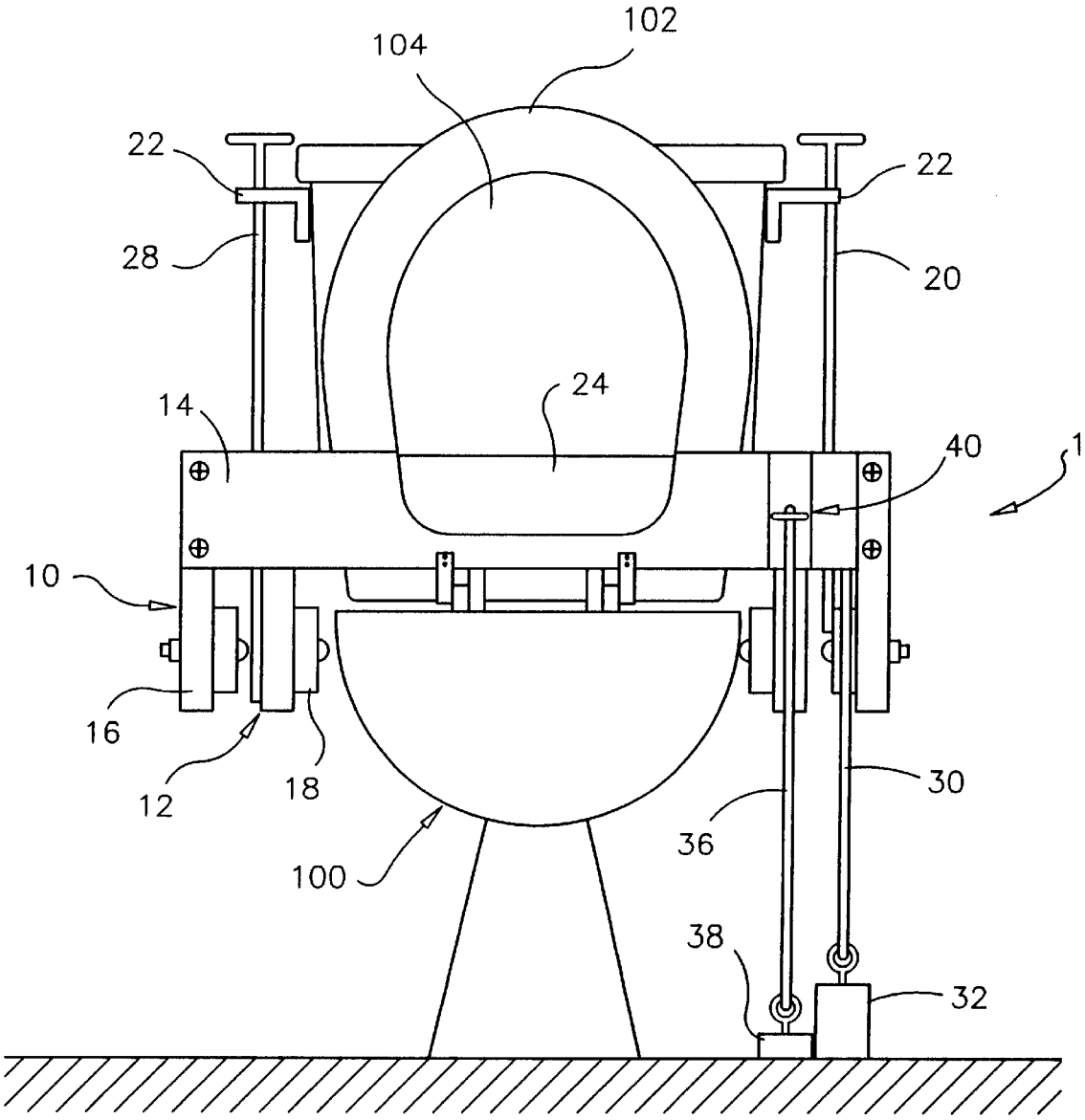
FIG. 9 is a front view of a toilet seat and cover lifter with the toilet seat in an upright position and with two foot pedals installed to lift and lower the toilet seat in accordance with the present invention.
Figure 10:
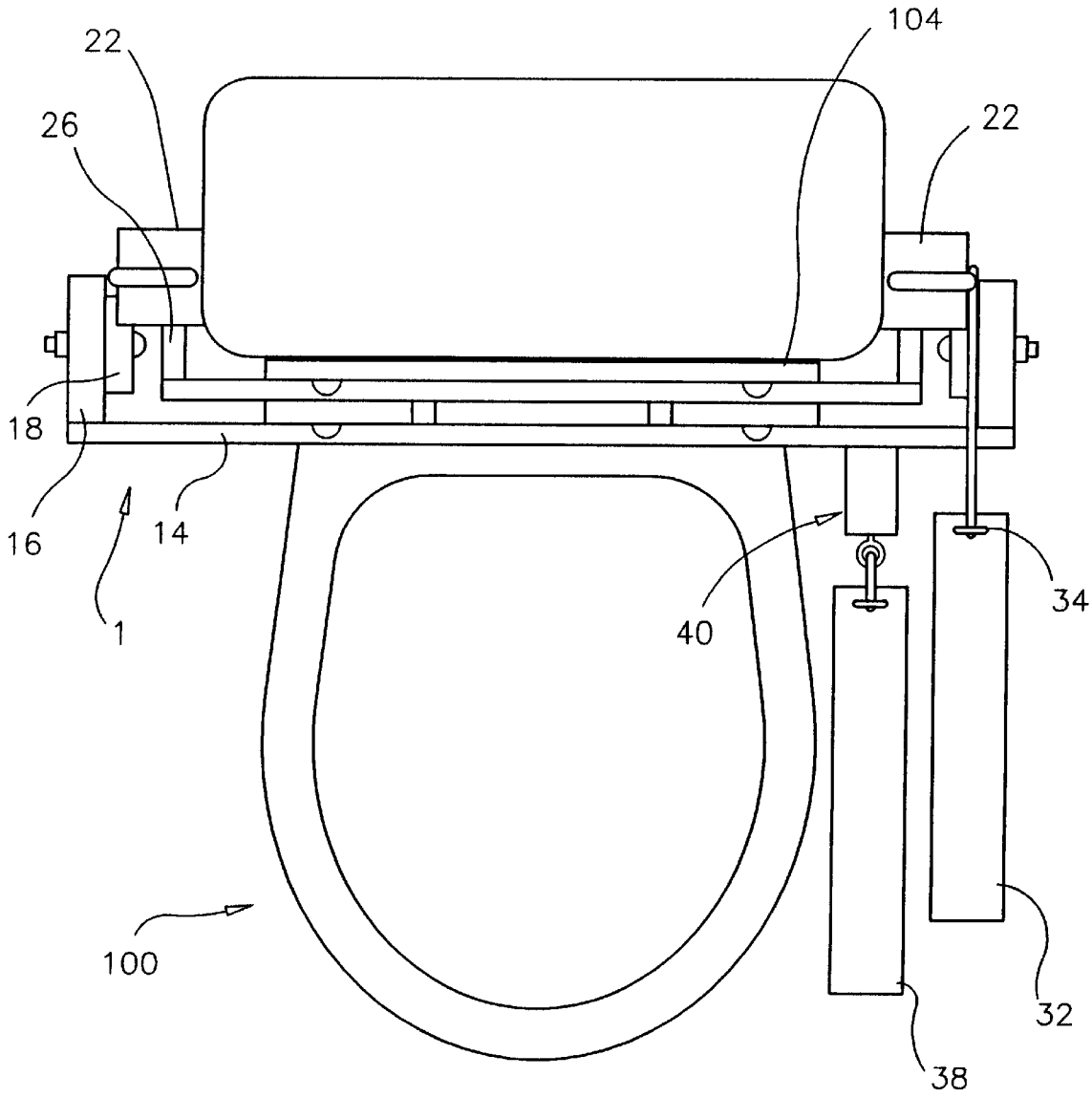
FIG. 10 is a top view of a toilet seat and cover lifter with the toilet seat in a horizontal position and with two foot pedals installed to lift and lower the toilet seat in accordance with the present invention.

With reference now to the drawings, and particularly to FIG. 1 there is shown a perspective view of a toilet seat and cover lifter 1 for attachment to a toilet 100. The toilet seat and cover lifter 1 includes a seat lifting assembly 10 and a cover lifting assembly 12. The seat lifting assembly 10 includes a seat lifting plate 14, a pair of seat arms 16, at least two counterweights 18, a seat vertical handle 20, and a vertical handle retainer 22. The cover lifting assembly 12 includes a cover lifting plate 24, a pair of cover arms 26, at least two counterweights 18, a cover vertical handle 28, and a vertical handle retainer 22.

With reference to FIGS. 2–6, the seat lifting assembly 10 is installed in the following manner. The seat lifting plate 14 is mounted to a bottom of a toilet seat 102 with any suitable fasteners or fastening method. Each seat arm 16 is fastened to an end of the seat lifting plate 14 with any suitable fasteners. The pair of seat arms 16 and the seat lift plate 14 may also be fabricated from a single piece of material such as molded plastic. Each seat arm has a slot 17 formed in a length thereof. At least one counterweight 18 is fastened to each seat arm 16 through the slot 17. The counterweights 18 are adjusted by sliding thereof in the slot 17 to reduce the amount force required to move the toilet seat 102 to an upright position. The counterweights 18 may be fastened to either the left side or right side of each seat arm 16. The seat vertical handle 20 is pivotally attached to an end of either toilet arm 16. A rod handle 21 preferably terminates a top end of the seat vertical handle 20. Someone with a bad back does not have to bend over to actuate the seat vertical handle 20. The toilet vertical handle 20 is radially retained inside the vertical handle retainer 22. The vertical handle retainer 22 is mounted to a side of the toilet tank 106. The vertical handle retainer 22 may be mounted to the toilet tank 106 with double sided tape, adhesive, or any other suitable method. The seat vertical handle 20 may be mounted to either the right or left side of the toilet tank 106.

The cover lifting assembly 10 is installed in the following manner. The cover lifting plate 24 is mounted to a bottom of a toilet cover 102 with any suitable fasteners or fastening method. Each cover arm 26 is fastened to an end of the cover lifting plate 24 with any suitable fasteners. The pair of cover arms 26 and the cover lift plate 24 may also be fabricated from a single piece of material such as molded plastic. Each cover arm has a slot 27 formed in substantially the length thereof. At least one counterweight 18 is fastened to each cover arm 26 through the slot 27. The counterweights 18 are adjusted by sliding thereof in the slot 27 to reduce the amount force required to move the toilet cover 104 to an upright position. The counterweights 18 may be fastened to either the left side or right side of each seat arm 26. The cover vertical handle 28 is pivotally attached to an end of either toilet arm 26. A rod handle 29 preferably terminates a top end of the cover vertical handle 28. Someone with a bad back does not have to bend over to actuate the cover vertical handle 28. The cover vertical handle 28 is radially retained inside the vertical handle retainer 22 which is mounted to a side of the toilet tank 106. The cover vertical handle 28 is mounted to the side opposite toilet vertical handle 20.

The toilet seat and cover lifter need only contain one lifting assembly. A single lifting assembly may used to move the toilet seat and cover together, or just the toilet seat by itself. The single lifting assembly may also be used to move only the toilet cover.

FIGS. 7–10 show a seat lifting assembly 10 which may be actuated with two foot pedals. One end of a lifting cord 30 is preferably attached to an eye bolt 34 which is attached to an end of a lifting pedal 32. The other end of the lifting cord 30 is attached to an end of the seat vertical handle 20 or an end of either seat arm 16. One end of a lowering cord 36 is preferably attached to an eye bolt 34 which is attached to an end of a lowering pedal 38. The other end of the lowering cord 36 is attached to a cord bracket 40 which is attached to an end of the seat lifting plate 14 with any suitable fastening method. The cord bracket 40 preferably has a normal leg 42 and an angled leg 44; cord brackets with other elements, structures, or designs could also be used, but the normal and angled legs are preferred. The lowering cord 36 may be secured to the cord bracket 40 by tying thereof around the normal or angled legs. The lifting and lowering cords are preferably fabricated from a rope. The lifting cord 30 could also be a cable, strip of flexible material, or any other suitable material. Other devices besides the eye bolts 34 may be used for retaining the lifting or lowering cords.

When the toilet seat is in a horizontal position, the lifting pedal 32 is stepped on, to raise the toilet seat 102. When the toilet seat 102 is in an upright position, the lowering pedal 38 is stepped on to lower the toilet seat 102. The amount of foot pressure required to lift or lower the toilet seat 102 is very small, because the seat and cover lifting assemblies are have counterweights 18. The two foot pedals could replace the seat vertical handle 20.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A toilet seat and toilet cover lifter comprising:

a lift plate being attached to a bottom of one of a toilet seat and toilet cover;

an arm extending from each end of said lift plate;

a pair of counterweights, at least one counterweight being slidably attached to each said arm; and a handle being attached to an end of one of said arms.

2. The toilet seat and toilet cover lifter of claim 1, further comprising:

a handle retainer radially restraining the movement of said handle, said handle retainer being mounted to a side of a toilet tank.

3. The toilet seat and toilet cover lifter of claim 1, wherein:

said handle being pivotally attached to one of said ends of one of said arms.

4. The toilet seat and toilet cover lifter of claim 1, wherein:

each said arm having a slot formed in a length thereof, said slot allowing each said counterweight to be adjusted relative to the length of the arm.

5. The toilet seat and toilet cover lifter of claim 1, further comprising:

a first foot pedal; and a first cord having one end attached to one end of said first foot pedal, the other end of said first cord being attached to an end of one of said arms, wherein said first foot pedal being depressed and pulling the toilet seat to an upright position.

6. The toilet seat and toilet cover lifter of claim 1, further comprising:

a second foot pedal; and a second cord having one end attached to one end of said second foot pedal, the other end of said second cord being attached to an end of said lift plate, wherein said second foot pedal being depressed and pulling the toilet seat to a horizontal position.

7. A toilet seat and toilet cover lifter comprising:

a lift plate being attached to a bottom of one of a toilet seat and toilet cover;

an arm extending from each end of said lift plate;

a pair of counterweights, at least one counterweight being slidably attached to each said arm;

a first foot pedal being depressed and pulling the toilet seat to an upright position; and a second foot pedal being depressed and pulling the toilet to a horizontal position.

8. The toilet seat and toilet cover lifter of claim 7, further comprising:

a first cord having one end attached to an end of said first foot pedal, the other end of said first cord being attached to an end of one of said arms.

9. The toilet seat and toilet cover lifter of claim 7, further comprising:

a second cord having one end attached to an end of said second foot pedal, the other end of said second cord being attached to an end of said lift plate.

10. The toilet seat and toilet cover lifter of claim 7, wherein:

each said arm having a slot formed in a length thereof, said slot allowing each said counterweight to be adjusted relative to the length of the arm.

11. The toilet seat and toilet cover lifter of claim 7, further comprising:

a handle being pivotally attached to one of said ends of one of said arms; and a handle retainer radially restraining the movement of said handle, said handle retainer being mounted to a side of a toilet tank.

12. A toilet seat and toilet cover lifter comprising:

a lift plate being attached to a bottom of one of a toilet seat and toilet cover;

an arm extending from each end of said lift plate, each said arm having a slot formed in a length thereof;

a pair of counterweights, at least one counterweight being slidably attached to said slot in each said arm;

a handle being pivotally attached to an end of one of said arms; and a handle retainer radially restraining the movement of said handle, said handle retainer being mounted to a side of a toilet tank.

13. The toilet seat and toilet cover lifter of claim 12, further comprising:

a first foot pedal; and a first cord having one end attached to one end of said first foot pedal, the other end of said first cord being attached to an end of one of said arms, wherein said first foot pedal being depressed and pulling the toilet seat to an upright position.

14. The toilet seat and toilet cover lifter of claim 12, further comprising:

a second foot pedal; and a second cord having one end attached to one end of said second foot pedal, the other end of said second cord being attached to an end of said lift plate, wherein said second foot pedal being depressed and pulling the toilet seat to a horizontal position.

15. A toilet seat and toilet cover lifter comprising:

a lift plate being attached to a bottom of one of a toilet seat and toilet cover;

an arm extending from each end of said lift plate, each said arm having a slot formed in a length thereof;

a pair of counterweights, at least one counterweight being slidably attached to said slot in each said arm;

a first foot pedal;

a first cord having one end attached to one end of said first foot pedal, the other end of said first cord being attached to an end of one of said arms, wherein said first foot pedal being depressed and pulling the toilet seat to an upright position;

a second foot pedal; and a second cord having one end attached to one end of said second foot pedal, the other end of said second cord being attached to an end of said lift plate, wherein said second foot pedal being depressed and pulling the toilet seat to a horizontal position.

16. The toilet seat and toilet cover lifter of claim 15, further comprising:

a handle being pivotally attached to one of said ends of one of said arms; and a handle retainer radially restraining the movement of said handle, said handle retainer being mounted to a side of a toilet tank.

17. The toilet seat lifter and toilet cover lifter of claim 15, further comprising:

a cord bracket extending from an end of said lift plate, the other end of said second cord being attached to said cord bracket.

* * * * *